United States Patent [19]

Stright

[11] 4,105,238

[45] Aug. 8, 1978

[54] ARTICLE HANDLING IMPLEMENT

[76] Inventor: Robert R. Stright, Village Plaza, Bainbridge, Wash. 98110

[21] Appl. No.: 759,766

[22] Filed: Jan. 17, 1977

[51] Int. Cl.[2] ..... A47J 49/14

[52] U.S. Cl. ..... 294/11; 294/104

[58] Field of Search ..... 294/11, 8.5, 10, 13, 294/11, 19 R, 22, 23, 50.8, 50.9, 104, 115

[56] References Cited

U.S. PATENT DOCUMENTS

| | | | |
|---|---|---|---|
| 2,125,214 | 7/1938 | Apgel, et al. | 294/11 |
| 3,118,697 | 1/1964 | Watters | 294/11 |

*Primary Examiner*—James B. Marbert

*Attorney, Agent, or Firm*—Graybeal, Barnard & Uhlir

[57] ABSTRACT

Implement for manipulating and carrying fire logs or the like and comprising inner jaws pivotally interconnected to a long handle near its load end, an actuating lever connected to the handle's other end, and a wire or cable connecting the actuating lever to the inner jaws. An outer jaw opposes and is pivotally connected between the inner jaws. A broken back linkage, located between the pivotal connections, connects the load end of the handle to the outer jaw. A spring normally maintains the broken back linkage in a non-broken attitude and the inner and outer jaws relatively open, in the absence of a fire log or the like between them. The broken back linkage is put into a broken condition and the jaws are closed to grasp the fire log when the actuating lever is actuated. The weight of the lifted article maintains the broken condition of the broken back linkage, and the relatively closed relation of the jaws around the article, even though the actuating lever is released.

8 Claims, 6 Drawing Figures

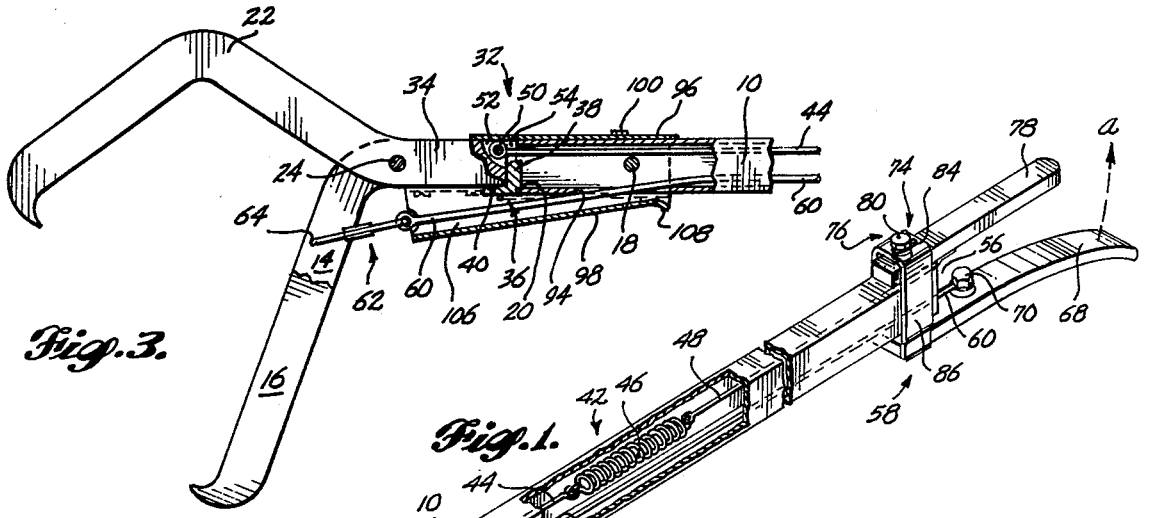
Fig. 3.
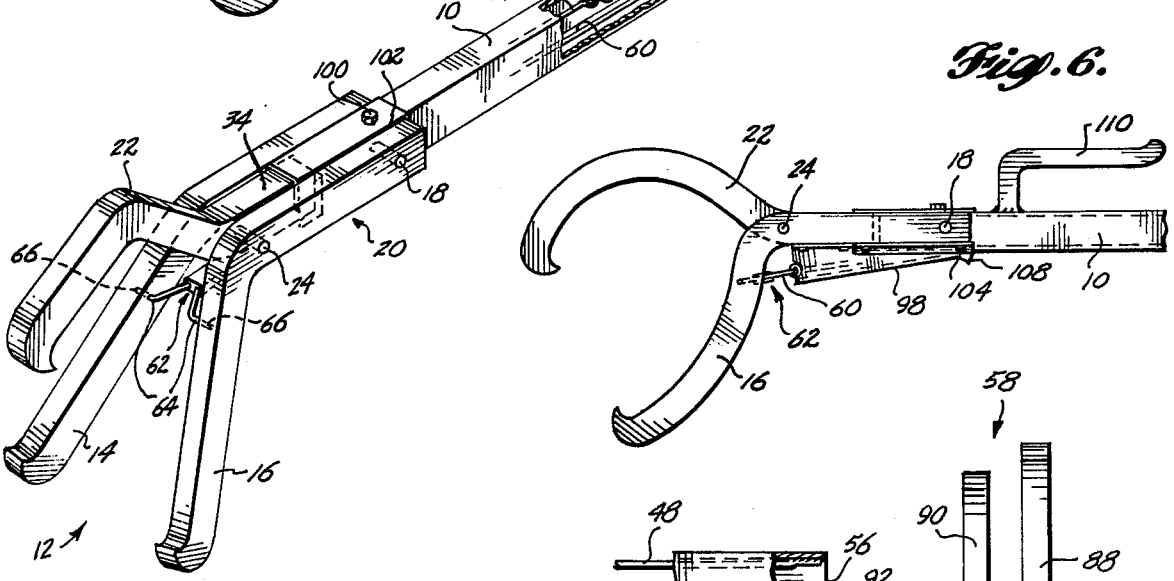
Fig. 1.
Fig. 6.
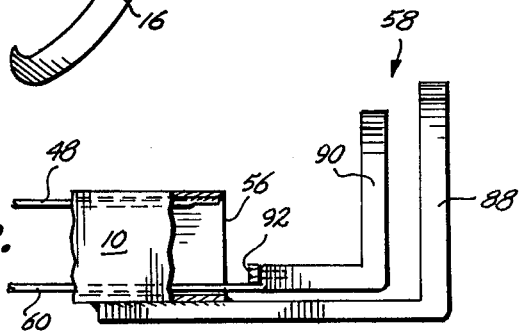
Fig. 2.
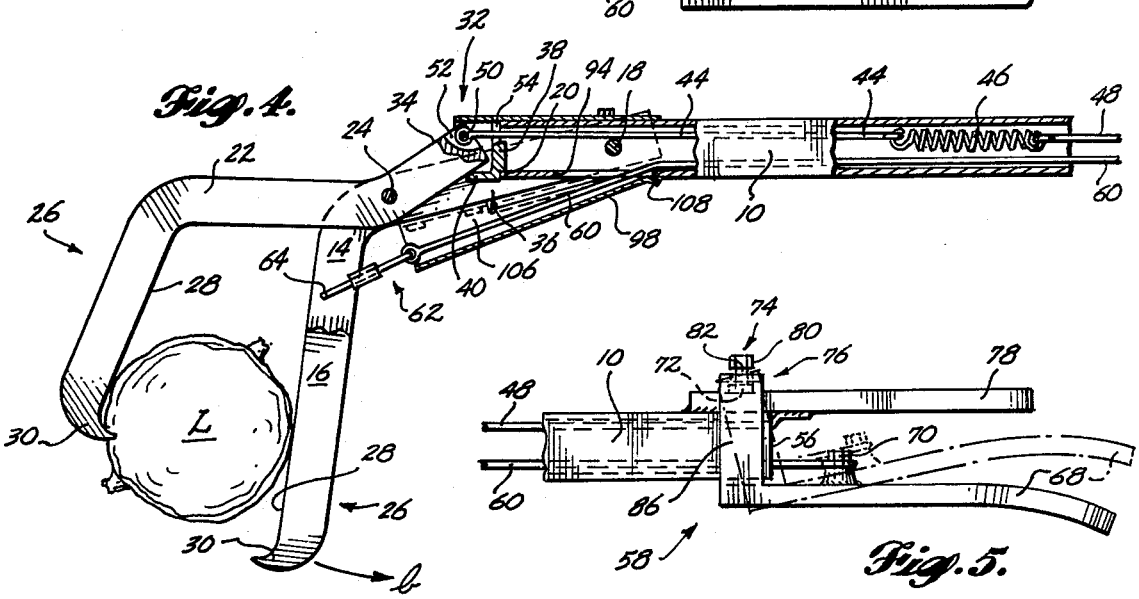
Fig. 4.
Fig. 5.

ARTICLE HANDLING IMPLEMENT

BACKGROUND OF THE INVENTION

1. Field of the Invention

The invention relates to implements for manipulating and carrying fire logs or the like, and more particularly to an implement for handling and carrying articles such as fire logs wherein the weight of the lifted article retains the jaws in a relatively closed relation about the article, even though the actuating lever is released, through the use of a broken back linkage located at the load end of the implement.

2. Description of the Prior Art

A fire fueled by solid fuels such as coal or wood frequently requires attention. Hot clinkers or other incombustable materials need to be removed from the fireplace or furnace so that they do not interfere with the burning of the remaining fuel. Also as the fire burns, rearrangement of the burning materials becomes necessary in order to ensure burning of unlit portions of the fuel, or to regulate the rate of combustion. Addition of fresh fuel requires careful placement to ensure its ignition while not extinguishing the existing fire.

Each of these operations requires either the manipulating and carrying of fiery materials or the placing of fresh fuel into a fiery environment.

Tongs suitable for performing these operations, such as disclosed in Hyatt U.S. Pat. No. 1,630,013 are old in the art and generally comprise a long handle with pivotally connected, opposed jaws at one end and actuating means at the other end. The jaws remain clenched as long as the actuating means are gripped, but loosen as soon as the pressure on the actuating means is relaxed or released. Such devices are dangerous and inconvenient in that loosening the pressure on the actuating means may cause the object in the jaws to slip or fall, with the attendant risk of fire or burns to the operator and to the nearby furnishings.

In addition, such devices are relatively strenuous to use in that the pressure required on the actuating means to hold the jaws closed about the load generally increases as the weight of the load increases. This results in fatigue to the operator when carrying heavy objects in the tongs, and increased danger that the operator's grip on the actuating means may weaken, thereby causing the object in the jaws to fall.

SUMMARY OF THE INVENTION

In basic form, the handling implement of the present invention comprises an elongate handle means having inner jaw means pivotally interconnected to it near its load end. Opposed outer jaw means are pivotally interconnected with the inner jaw means, and are interconnected to the load end of the handle means by a broken back linkage means which is situated between said pivotal interconnections. A spring means normally maintains the broken back linkage means in a non-broken attitude and maintains said jaws in a relatively open relation in the absence of a log or like substantial weight between said jaws. The linkage is maintained in a broken attitude and the opposed inner and outer jaw means are maintained in a relativley closed relation about the article held by the weight of the article being lifted by the tong-like handling implement.

In another aspect of the invention, said jaw means are initially closed about the held article by actuating means connected to the actuating end of the handle means and interconnected by cable means to the inner jaw means.

According to a further aspect of the invention, the broken back linkage means comprises a tongue means extending outwardly from the load end of the handle means and a rocker portion of the outer jaw means. The rocker portion of the outer jaw means lies over and extends past the full length of the tongue means and extends between the load end of the handle means and the pivotal interconnection between the inner and outer jaw means.

It is a basic object and advantage of the implement of the present invention that once an article such as a fire log is lifted in the jaws of the implement, the weight of the log causes the jaws to remain in a relatively closed relation even though the actuating means is completely released by the operator. This, of course, has the desirable effect of reducing user fatigue because he does not have to constantly squeeze the actuating means in order to maintain the grip of the jaws on the article.

Another object and advantage of the handling implement of the invention is that the grip of the jaws on the article being carried increases as the weight of the article increases, even though the operator may completely release the actuating lever, resulting in a lessening of the danger that a heavy article might be dropped. This results in increased safety for the user and nearby surroundings because, in the instance where the article is a fire log, the chance of burns and fire caused by a dropped, burning log is reduced. Similarly, the danger that a dropped, cool fire log may physically injure the user or cause burning fuel in the fireplace to be scattered, with the attendant risk of fire and burns, is also reduced.

A further object and advantage of the article handling implement of the present invention is that the user's convenience is greatly increased. Since the user may completely release the actuating lever once the article is lifted, he may thereafter shift the placement of his hands on the implement as the situation dictates.

These and other objects, features, advantages and characteristics of the article handling implement of the present invention will be apparent from the following more detailed description of certain typical embodiments thereof.

BRIEF DESCRIPTION OF THE DRAWINGS

FIG. 1 is an isometric view of the article handling implement of the present invention shown with the jaws retained in an open position by a spring shown in a cutaway portion of the handle;

FIG. 2 is a pictorial representation of an alternative form of the actuating means of the present invention;

FIG. 3 is a side elevational view of the jaws portion of the article handling implement of FIG. 1 with portions broken away for clarity of illustration, showing the jaws in an open position and the broken back linkage in a non-broken attitude;

FIG. 4 is a side elevational view like FIG. 3 showing the broken back linkage in a broken condition and the jaws closed about a fire log.

FIG. 5 is a side elevational view of the actuating end of the handle showing the actuating means in detail; and FIG. 6 is a side elevational view of another embodiment of the article handling implement of FIG. 1, showing a hand grip at the jaws end of the handle means and arcuate shaped jaws.

DESCRIPTION OF THE PREFERRED EMBODIMENT

As will be understood, the implement of the present invention, for handling a fire log or the like, is useful in any situation where it becomes necessary to manipulate fiery objects, such as when removing hot clinkers from a furnace or when adjusting burning logs and coals in a fireplace. It is also useful for grasping and carrying relatively cool objects which must be inserted into a fiery environment, such as when placing fresh fuel on a fire.

The handling implement for a fire log or the like shown in FIG. 1 has an elongate handle means 10 made from tubular steel or the like; but it is understood that the handle 10 could also be made from a flammable material, such as wood, suitably protected as by metal sheathing, when it might be exposed to fire.

The inner jaw means, generally designated at 12, comprises a pair of inner jaws 14, 16 having a pivotal interconnection 18 with the handle 10 near its load end 20. The outer jaw means comprises an outer jaw 22 which is positioned between the inner jaws 14, 16 and has a pivotal interconnection 24 therewith. Although two inner jaws 14, 16 and one outer jaw 22 is illustrated, both the inner and the outer jaw means may each comprise one or more jaws. As shown in FIG. 4, the inner and outer jaws 14, 16, 22 are opposed and coact to grasp the fire log L, with each jaw having a log engaging portion 26 comprising a relatively straight portion 28 and a hooked end 30. But as shown in FIG. 6, any, or all, jaws can be arcuate in shape. Further, the jaws can be sized to engage the size of fire log most frequency encountered.

Referring to FIGS. 3 and 4, a broken back linkage means, generally designated at 32, interconnects the outer jaw 22 and the handle 10. It is positioned between the pivotal interconnections 18 and 24 and comprises a rocker portion 34 of the outer jaw and a tongue means, generally designated at 36. The rocker portion 34 overlies the tongue means 36 and extends from adjacent the load end 20 of the handle to the pivotal interconnection 24. The tongue means 36 comprises an L-shaped member having a vertical portion 38 fixedly attached to the load end 20 of the handle, as by welding, and a horizontal portion which forms a tongue 40 that extends longitudinally outwardly therefrom. Of course, the tongue 40 could also be formed by cutting away a portion of the load end 20 of the handle, or by rigidly attaching, as by welding, a short, flat piece of metal to the bottom of the load end 20 of the handle.

Referring to FIGS. 1 and 3, a spring means, generally designated at 42, interconnects the rocker portion 34 of the outer jaw and the handle 10. It comprises a spring link 44, a spring 46, and a spring anchor link 48. One end of the spring link 44 is rotatably connected to a rocker pivot 50 positioned in a rocker slot 52 that is situated in the outer jaw adjacent to the top of the load end 20 of the handle. A spring aperture 54 permits passage of the spring link 44 through the vertical portion 38 of the L-shaped member for connection to one end of the spring 46. The other end of the spring 46 is attached to the spring anchor link 48, which is, in turn, anchored near the actuating end 56 of the handle, as by welding. Of course, the spring anchor link 48 may be eliminated and one end of the spring 46 may be anchored directly to the handle 10 at a convenient location.

The spring means 42 can take many forms. For example, the spring links 44, 48 can be eliminated so that the spring means 42 comprises solely a spring 46. In such event, one end of the spring can be made straight and pass through the spring aperture 54 to be connected directly to the rocker pivot 50, while the other end of the spring 46 is anchored at a nearby convenient location, such as the pivotal interconnection 18.

In all embodiments the tension of the spring 46 is selected so that it is just sufficient to overcome the weight of the inner and outer jaws 14, 16, 22 so that the broken back linkage means 32 are maintained in a relatively non-broken condition, and so that the inner and outer jaws 14, 16, 22 are maintained in a relatively open relation, in the absence of the weight of a lifted fire log L in said jaws.

As shown in FIGS. 1 and 5, an actuating means, generally designated at 58, is movably attached to the handle near to its actuating end 56, and is interconnected to the inner jaws 14, 15 by a cable means 60. The cable means 60 comprises comprises a stiff wire, a wire rope, or the like. One end of the cable means 60 is connected to the inner jaws 14, 16 by means of a cable yoke 62 having ends 64 that are rotatably mounted in the inner jaws, as by yoke holes 66. The other end of the cable means 60 is anchored to the actuating lever 68 as by fastener 70.

The actuating means 58 comprises a pivot 72, a pivot fastener 74, an actuating yoke 76, and an actuating lever 68. The pivot 72 extends radially from the top of the hand grip 78 and is affixed thereto, as by welding. The hand grip 78 is affixed to the top of the handle near its actuating end 56, as by welding, and extends longitudinally past it for a moderate distance. The actuating yoke 76 is movably mounted to the top of the pivot 72 by the head 80 of the pivot fastener 74 whose shank 82 passes through a yoke aperture 84 that is sized smaller than the top of the pivot 72. The actuating yoke 76 has a pair of arms 86 that extend downwardly on opposite sides of the handle near its actuating end 56 and are affixed, as by welding, to the front of the actuating lever 68. The actuating lever 68 extends longitudinally from the actuating end 56 of the handle and curves slightly downwardly at its end so as to better fit the hand of the operator.

Another such form of actuating means is illustrated in FIG. 2 and comprises an upturned hand grip 88 rigidly joined to the handle near to its actuating end 56, as by welding, and an upturned actuating arm 90 which is connected by suitable fastener means 92 to the cable means 60.

The two forms of actuating means previously described are merely by way of example, and many other forms of actuating means 58 will readily occur to those skilled in the art.

As shown in the preferred embodiment in FIG. 1, both the spring means 42 and the cable means 60 are located within the handle means 10. As shown in FIG. 3, the cable means 60 passes through a longitudinal cable slot 94 located in the bottom of the handle near its load end 20 in exiting the interior of the handle 10 to make connection with the cable yoke 62. However, it is possible that the handle 10 be a solid bar or rod in which case both the spring means 42 and the cable means 60 would be carried adjacent to the exterior of the bar by any of a variety of means that will readily occur to those skilled in the art.

Top and bottom shields 96, 98, respectively, protect the operator from catching his fingers in the broken back linkage means 32 and also protect the linkage 32 from fire and the entry of foreign matter. The top shield 96 is detachably mounted to the top of the handle near its load end 20, as by fastener 100, and overlies a portion of both the rocker portion 34 of the outer jaw and the handle near its load end 20. It is generally of a U-shaped cross-section and has side portions 102 that extend downwardly on both sides of the handle 10 between the handle 10 and the inner jaws 14, 16.

Bottom shield 98 is detachably mounted to the bottom of the inner jaws 14, 16, as by fasteners 104, and extends from the cable slot 94 to the cable yoke 62. It has a longitudinal recess 106 within which the cable means 60 travels, and a stop portion 108 which engages the bottom of the handle 10 to limit the amount of travel of the inner and outer jaws 14, 16, 22.

Turning to a consideration of the operation and manner of use of the article handling implement of the present invention, the user first takes the hand grip 78 and the actuating lever 68 in one hand, and grasps the handle near its load end 20 with his other hand. If desired, an auxiliary hand grip 110 can be provided for this purpose near the load end 20 of the handle, as is illustrated in the embodiment shown in FIG. 6. At this time no pressure is put on the actuating lever 68 so that the spring means 42 maintains the broken back linkage means 32 in a non-broken condition and maintains the inner and outer jaws 14, 16, 22 in a relatively open relation as shown in FIG. 3. Next the user selects the fire log L, or other object to be manipulated, and positions the open jaws about it.

To grasp the fire log L, the user squeezes the actuating lever 68, so that it moves upwardly in the direction indicated by the arrow *a* in FIG. 1. This causes the inner jaws 14, 16 and the pivotal interconnection 24 to rotate downwardly and towards the handle 10 about the pivotal interconnection 18 as indicated by arrow *b* in FIG. 4. As the pivotal interconnection 24 rotates downwardly and towards the handle 10, the end of the tongue 40 pushes the rocker portion 34 of the outer jaw upwardly about the pivotal interconnection 24. This causes the log engaging portion 26 of the outer jaw 22 to move relatively closer to the inner jaws 14, 16, thereby causing the fire log L to be grasped between the inner and outer jaws. When the user lifts the fire log, its weight comes to bear on the inner and outer jaws and overcomes the tension of the spring 46, thereby causing the inner jaws to remain in their rotated position. This maintains the inner and outer jaws relatively closed about the firelog and maintains the broken back linkage means 32 in a broken condition, even though the actuating lever 68 is released. The user is now free to change the position of his hands on the handle as his convenience and the situation demands. To release the fire log, the user merely sets the fire log down on some object so that its weight is taken off the inner and outer jaws. This permits the spring 46 to return the broken back linkage means 32 to its non-broken condition, and to return the inner and outer jaws to their relatively open position, so that the implement is ready for use again.

From the foregoing, various further applications, modifications and adaptations of the apparatus disclosed and the invention embodied therein will be apparent to those skilled in the art to which the invention is addressed, within the scope of the following claims.

What is claimed is:

1. Article handling apparatus for manipulating a fire log or the like, comprising:

a. opposed outer and inner jaw means;
b. a pivotal interconnection between said jaw means;
c. elongate handle means having a load end and an actuating end;
d. a pivotal interconnection between said inner jaw means and said handle means near said load end;
e. broken back linkage means interconnecting said outer jaw means and said handle means and situated between said pivotal interconnections; and
f. spring means normally maintaining said broken back linkage means in non-broken attitude, the tension of said spring means and the configuration of said outer and inner jaw means being such that the said jaws are relatively open and said linkage is non-broken in the absence of a log or like substantial weight between said jaws, and said jaws are maintained relatively closed and said linkage is maintained broken by the weight of a log or the like being retained by said jaws.

2. The apparatus as recited in claim 1, further comprising:

a. actuating means connected to said actuating end of the handle means;
b. cable means interconnecting said actuating means and said inner jaw means.

3. The apparatus as recited in claim 2, wherein said inner jaw means comprises two laterally spaced jaws.

4. The apparatus as recited in claim 1, wherein said inner jaw means comprises two laterally spaced jaws.

5. The apparatus as recited in claim 1, wherein said outer jaw means comprises a single jaw.

6. The apparatus as recited in claim 1, wherein said inner jaw means comprises two laterally spaced jaws and wherein said outer jaw means comprises a single jaw.

7. The apparatus as recited in claim 6, further comprising:

a. actuating means connected to said actuating end of the handle means; b. cable means interconnecting said actuating means and said inner jaw means.

8. The apparatus as recited in claim 1, wherein said broken back linkage comprises:

a. tongue means extending outwardly from said load end of the handle means; and
b. a rocker portion of said outer jaw means extending between said load end of the handle means and said pivotal interconnection between said inner and outer jaw means, and lying over and extending past the full length of said tongue means.

* * * * *